US005926140A

United States Patent [19]

Yokoyama

[11] Patent Number: 5,926,140

[45] Date of Patent: Jul. 20, 1999

[54] ANTENNA FOR PORTABLE RADIO UNIT

[75] Inventor: Yukio Yokoyama, Saitama, Japan

[73] Assignee: NEC Corporation, Tokyo, Japan

[21] Appl. No.: 08/890,403

[22] Filed: Jul. 9, 1997

[30] Foreign Application Priority Data

Jul. 12, 1996 [JP] Japan ..... 8-200979

[51] Int. Cl.[6] ..... H01Q 1/24; H01Q 1/36

[52] U.S. Cl. ..... 343/702; 343/895; 343/900

[58] Field of Search ..... 343/702, 895, 343/790, 900, 901, 903

[56] References Cited

U.S. PATENT DOCUMENTS

| | | | |
|---|---|---|---|
| 4,121,218 | 10/1978 | Irwin et al. | 343/702 |
| 5,757,325 | 5/1998 | Saldell | 343/702 |

FOREIGN PATENT DOCUMENTS

| | | | |
|---|---|---|---|
| 0 511 577 | 11/1992 | European Pat. Off. | H04B 1/38 |
| 0 747 989 | 12/1996 | European Pat. Off. | H01Q 1/24 |
| 5-102717 | 4/1993 | Japan | H01Q 1/24 |
| 6-216630 | 8/1994 | Japan | H01Q 9/30 |
| 7-131220 | 5/1995 | Japan | H01Q 1/24 |
| 7-508868 | 9/1995 | Japan | H01Q 1/24 |
| 7-336122 | 12/1995 | Japan | H01Q 1/24 |
| 8-32333 | 2/1996 | Japan | H01Q 1/24 |
| 2 253 949 | 9/1992 | United Kingdom | H01Q 1/08 |
| 2 296 603 | 7/1996 | United Kingdom | H01Q 1/10 |

OTHER PUBLICATIONS

Japanese Office Action dated Sep. 8, 1998 with English language translation of Japanese Examiner's comments.
British Search Report, dated Sep. 26, 1997.

*Primary Examiner*—Don Wong
*Assistant Examiner*—Jennifer H. Malos
*Attorney, Agent, or Firm*—Whitham, Curtis & Whitham

[57] ABSTRACT

An antenna for a portable radio unit includes a helical element, a rod-like whip element, a helical element power supply terminal, a whip element power supply terminal, a ground conductor, and a ground connection terminal. The helical element is arranged on a portable radio unit housing, and its diameter, pitch, and length are set in accordance with a carrier frequency having a wavelength λ. The whip element is extended and stored by reciprocating inside a helical portion of the helical element, and is completely stored in the portable radio unit housing. The whip element has a length of λ/2. The helical element power supply terminal is connected to one end of the helical element to supply power only to it when the whip element is stored. The whip element power supply terminal is arranged at a predetermined position of the helical element to supply power to the whip element through the helical power supply terminal and the helical element when the whip element is extended. The ground conductor is arranged on a lower end portion of the whip element through an insulating portion. The ground connection terminal grounds the ground conductor when the whip element is extended.

6 Claims, 2 Drawing Sheets

ANTENNA FOR PORTABLE RADIO UNIT

BACKGROUND OF THE INVENTION

The present invention relates to an antenna for a portable radio unit and, more particularly, to an antenna for a portable radio unit obtained by combining a helical antenna element and an extendible, retractable whip antenna element.

Various types of antennas are used as portable radio antennas. A whip antenna is desirable in the communication mode in terms of obtaining a maximum gain by decreasing degradation in gain caused by the human body, and a small antenna, e.g., a helical antenna, is desirable in the wait mode as it can be conveniently carried around.

Accordingly, an antenna obtained by combining a helical antenna element and an extendible whip antenna element is conventionally known. In the communication mode, the whip antenna element is extended and operated. In the wait mode, the whip antenna element is retracted and the helical antenna element is operated.

According to an example of the arrangement of the conventional antenna of this type, for example, a helical antenna element is formed on the distal end of a whip antenna element. When the whip antenna element is extended, power is supplied to the whip antenna element. When the whip antenna element is retracted, power is supplied to the helical antenna element.

The diameter, pitch, and length of the helical antenna element must be determined in accordance with the transmitted and received carrier frequency, so that desirable relative bandwidth and resonant frequency can be obtained. Also, in order to decrease degradation in gain caused by the human body during communication, the length of the whip antenna element must be set to about $\lambda/2$. Therefore, the input impedances of the two antenna elements are usually largely different from each other, and it is thus difficult to realize an optimum matching state when the whip antenna element is extended and retracted.

As described above, in the conventional antenna obtained by combining the helical antenna element and the whip antenna element, the following method must be inevitably used. The antenna is used while allowing mismatching. Alternatively, the length of the whip antenna and the size of the helical antenna are changed from the above-mentioned determined values so as to facilitate matching.

SUMMARY OF THE INVENTION

It is an object of the present invention to provide an antenna for a portable radio unit obtained by combining a helical antenna element and a whip antenna element, which can realize a good matching state when the whip antenna element is extended and retracted.

In order to achieve the above object, according to an aspect of the present invention, there is provided an antenna for a portable radio unit comprising a helical antenna element which is arranged on a portable radio unit housing and a diameter, a pitch, and a length of which are set in accordance with a carrier frequency having a wavelength $\lambda$, a rod-like whip antenna element which is extended and stored by reciprocating inside a helical portion of the helical antenna element, and which is completely stored in the portable radio unit housing, the whip antenna element having a length of $\lambda/2$, a first power supply terminal connected to one end of the helical antenna element to supply power only thereto when the whip antenna element is stored, a second power supply terminal arranged at a predetermined position of the helical antenna element to supply power to the whip antenna element through the first power supply terminal and the helical antenna element when the whip antenna element is extended, a ground conductor arranged on a lower end portion of the whip antenna element through an insulating portion, and a ground connection terminal for grounding the ground conductor when the whip antenna element is extended.

DESCRIPTION OF THE PREFERRED EMBODIMENTS

The preferred embodiments of the present invention will be described in detail with reference to the accompanying drawings.

Figure 2:
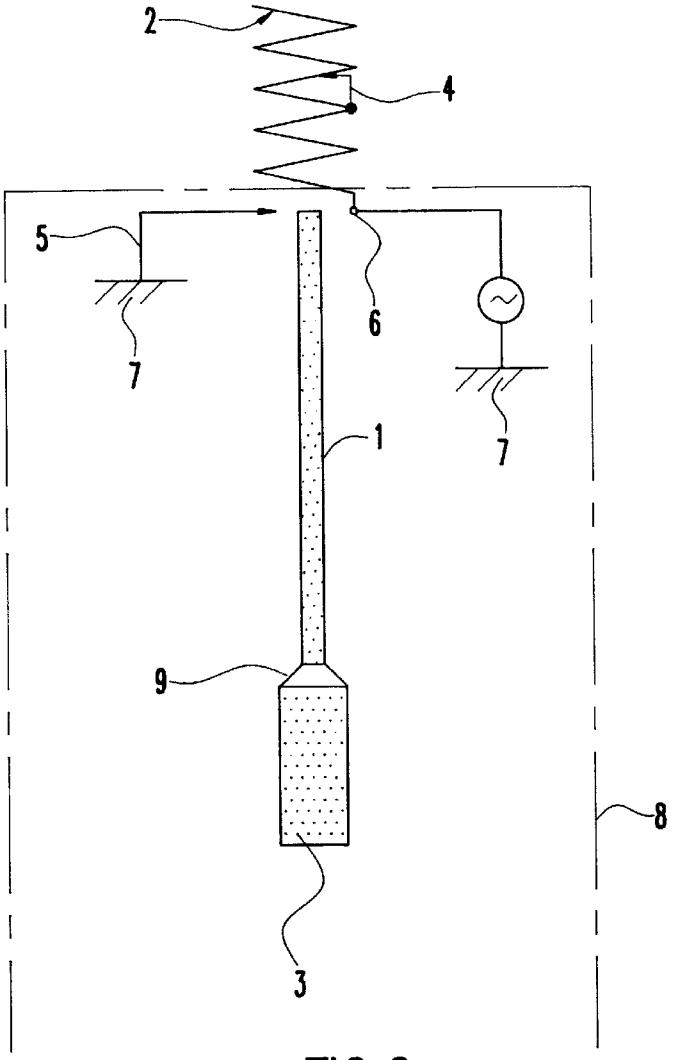
FIG. 2A is a view showing the attaching position of the whip element power supply terminal shown in FIGS. 1A and 1B.
FIG. 2B is a view showing the gap between the ground conductor and helical element shown in FIGS. 1A and 1B.
Figure 1:
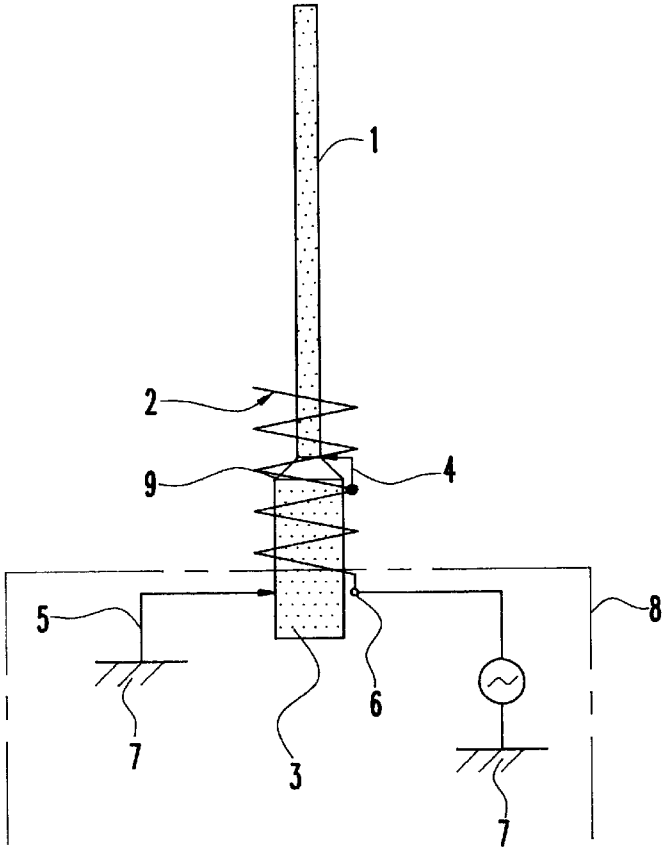
FIGS. 1A and 1B are views for explaining states wherein an antenna for a portable radio unit according to the first embodiment of the present invention is extended and stored, respectively.

FIGS. 1A and 1B explain the operating state of an antenna for a portable radio unit according to an embodiment of the present invention. Referring to FIG. 1A, a whip antenna element (to be referred to as a whip element hereinafter) 1 is extended from and stored in a portable radio unit housing 8. The whip element 1 has a length of about $\lambda/2$ where $\lambda$ is the wavelength of the transmitted and received carrier wave. A helical antenna element (to be referred to as a helical element hereinafter) 2 has one end fixed to the portable radio unit housing 8. When the whip element 1 is stored, the helical element 2 operates alone. The diameter, pitch, and length of the helical element 2 are set in accordance with the transmitted and received carrier frequency.

A ground conductor 3 is attached to the lower end portion of the whip element 1 through an insulating portion 9. When the whip element 1 is extended, the lower portion of the ground conductor 3 remains in the portable radio unit housing 8. A whip element power supply terminal 4 is attached to the helical element 2 to supply power to the whip element 1 when the whip element 1 is extended. A ground connection terminal 5 is formed in the upper portion inside the portable radio unit housing 8 to come into electrical contact with the ground conductor 3 when the whip element 1 is extended. A helical element power supply terminal 6 supplies power to the helical element 2. Reference numeral 7 denotes ground.

The helical element 2 has one end fixed to the portable radio unit housing 8. Power is supplied to the fixed end of the helical element 2 from the helical element power supply terminal 6. The whip element power supply terminal 4 is arranged at a predetermined position of the helical element 2 which is determined by the matching condition of the whip element 1. The whip element 1 having a length of $\lambda/2$ moves inside the helical portion of the helical element 2 so that it is extended from and stored in the portable radio unit housing 8.

The ground conductor 3 attached to the lower end of the helical element 2 through the insulating portion 9 reciprocates in the vertical direction together with the whip element 1. When the whip element 1 is extended, the ground conductor 3 advances into the helical element 2. Since the ground conductor 3 has such a length that the lower end portion of the whip element 1 advances near to the whip element power supply terminal 4, when the whip element 1 is extended, its lower end portion is connected to the whip element power supply terminal 4. For this reason, power is supplied to the whip element 1 through the helical element power supply terminal 6, helical element 2, and whip element power supply terminal 4. At this time, the ground conductor 3 is connected to the ground 7 through the ground connection terminal 5.

When the whip element 1 is stored, the whip element 1 and the ground conductor 3 are completely stored to a position in the portable radio unit housing 8 where they do not come into contact with the ground connection terminal 5.

Input impedance matching of the antenna having the above arrangement will be described. The size (diameter, length, and pitch) of the helical element 2 is determined so that the helical element 2 has predetermined resonant frequency, bandwidth, and matching characteristics. A gap w between the ground conductor 3 and helical element 2 shown in FIG. 2B, and a portion A of the helical element 2 between the power supply terminal 6 to the helical element 2 and the power supply terminal 4 to the whip element 1 and a portion B of the helical element 2 are determined so that predetermined characteristics can be obtained when the whip element 1 is extended.

When the whip element 1 is extended, radiation from the portion A is interfered by the ground conductor and the portion A operates as a matching circuit. Although a power is supplied to the portion B of the helical element 2 in parallel with the whip element 1, an experiment conducted by the present inventors confirmed that the helical element 2 has substantially the same characteristics as a whip element alone.

Accordingly, when the whip element 1 is extended, the helical element 2 operates only as a matching element, and its reception characteristics are determined by the length of whip element 1. When the whip element 1 is stored, the whole helical element 2 is not influenced by the whip element 1 but operates as an antenna element.

Figure 3:
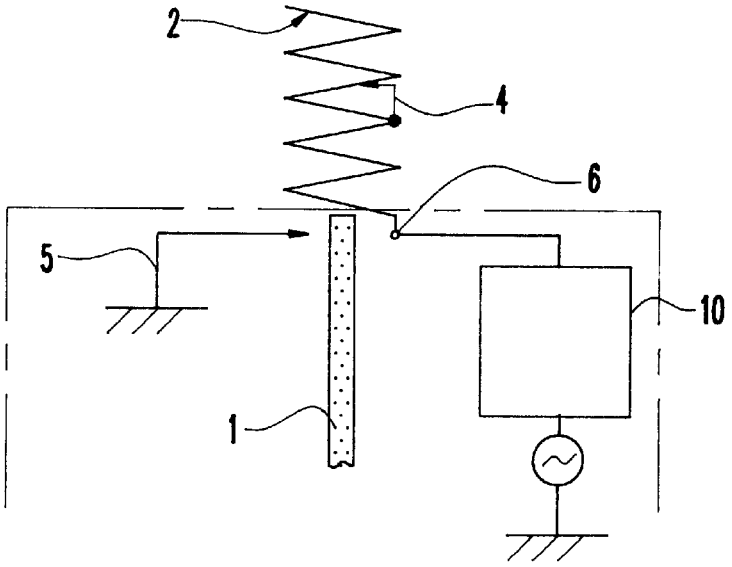
FIG. 3 is a view for explaining a state wherein an antenna for a portable radio unit according to the second embodiment of the present invention is stored.

FIG. 3 explains a state when an antenna for a portable radio unit according to the second embodiment of the present invention is stored. In the embodiment shown in FIGS. 1A and 1B, when the helical element 2 is downsized, impedance matching cannot sometimes be obtained. In the second embodiment, a matching circuit 10 for obtaining impedance matching is arranged between a helical element power supply terminal 6 and a power supply.

Figure 2A:
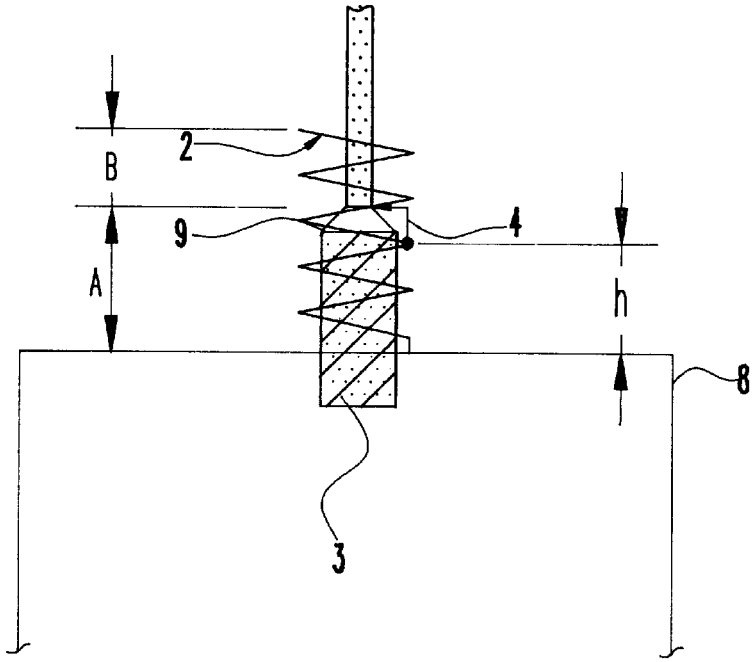
Figure 2B:
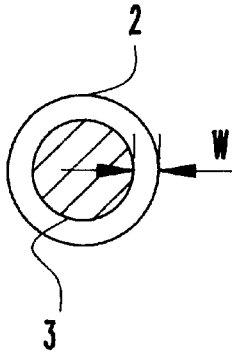

Even when the matching circuit 10 is arranged in this manner, impedance matching can be easily obtained when the whip element is extended by adjusting the gap w between the ground conductor 3 and the helical element 2, as shown in FIG. 2B, and the position h of the whip element power supply terminal 4, as shown in FIG. 2A.

As has been described above, according to the present invention, when the whip element is extended, matching can be obtained not by the structure of the helical element but by adjusting the attaching position of the whip element power supply terminal and the gap between the ground conductor and the helical element. Therefore, even if the length of the whip element that operates when extended is set to about $\lambda/2$ and the size of the helical element that operates when the whip element is stored is individually determined such that predetermined characteristics can be obtained during operation, an optimum matching state can be satisfied easily when the whip element is extended and retracted.

What is claimed is:

1. An antenna for a portable radio unit comprising:

a helical antenna element which is arranged on a portable radio unit housing and a diameter, a pitch, and a length of which are set in accordance with a carrier frequency having a wavelength $\lambda$;

a rod-like whip antenna element which is extended and stored by reciprocating inside a helical portion of said helical antenna element, and which is completely stored in said portable radio unit housing, said whip antenna element having a length of $\lambda/2$;

a first power supply terminal connected to one end of said helical antenna element to supply power only thereto when said whip antenna element is stored;

a second power supply terminal arranged at a predetermined position of said helical antenna element to supply power to said whip antenna element through said first power supply terminal and said helical antenna element when said whip antenna element is extended;

a ground conductor arranged on a lower end portion of said whip antenna element through an insulating portion; and a ground connection terminal for grounding said ground conductor when said whip antenna element is extended, wherein when said whip antenna element is extended, said lower end portion of said whip antenna element advances near to said second power supply terminal, and said helical antenna element between said first and second power supply terminals operates as an impedance matching element.

2. An antenna according to claim 1, wherein a portion between said second power supply terminal and one end of said helical antenna element connected to said first power supply terminal, and a gap between said helical antenna element and said ground conductor, are adjusted to optimize impedance matching properties when said whip antenna element is extended.

3. An antenna according to claim 1, further comprising a matching circuit connected to said first power supply terminal to obtain impedance matching when said whip antenna element is stored.

4. An antenna system for matching impedance for a helical antenna element and a retractable whip antenna element for a radio device, comprising:

a whip antenna slidable through a center portion of a helical antenna, said helical antenna having a base electrically connected to a radio device, said whip antenna comprising an active upper portion and a ground conductor lower portion for contacting a ground terminal in an extended position, said helical antenna comprising a power supply terminal positioned at a connection point along its length and away from a distal end extending towards a center of said helical antenna for connecting to said whip antenna when said whip antenna slides into the extended position, said connection point positioned such that a portion of the helical antenna below said connection point acts as an impedance matching circuit.

5. An antenna system for matching impedance for a helical antenna element and a retractable whip antenna element for a radio device as recited in claim 4 wherein the active upper portion of said whip antenna has a length of $\lambda/2$, where $\lambda$ is a wavelength of a carrier wave transmitted and received by the radio device.

6. An antenna system for matching impedance for a helical antenna element and a retractable whip antenna element for a radio device as recited in claim 5, wherein a gap between said ground conductor and said helical antenna is chosen to optimize performance.

* * * * *